United States Patent [19]

Andre et al.

[11] 4,065,199

[45] Dec. 27, 1977

[54] FLAT CABLE WIRING HARNESS AND METHOD OF PRODUCING SAME

[75] Inventors: Michael G. Andre, Palatine; Melvin J. Schmidt, Elk Grove Village; Kenneth L. Osman, Chicago, all of Ill.

[73] Assignee: Methode Electronics, Inc., Chicago, Ill.

[21] Appl. No.: 767,754

[22] Filed: Feb. 11, 1977

[51] Int. Cl.[2] ..... H01R 11/20

[52] U.S. Cl. ..... 339/17 F; 174/72 A; 339/97 C; 339/223 R

[58] Field of Search ..... 339/17 F, 97 C, 176 MF, 339/223; 174/72 A, 117 FF

[56] References Cited

U.S. PATENT DOCUMENTS

| | | | |
|---|---|---|---|
| 3,226,473 | 12/1965 | Dahlgren | 174/117 FF |
| 3,727,168 | 4/1973 | Henschen et al. | 339/17 F |
| 3,960,430 | 6/1976 | Bunnell et al. | 339/97 C |
| 3,997,233 | 12/1976 | Evans | 339/97 C |

FOREIGN PATENT DOCUMENTS

| | | | |
|---|---|---|---|
| 1,257,800 | 12/1971 | United Kingdom | 339/17 F |

*Primary Examiner*—Joseph H. McGlynn
*Attorney, Agent, or Firm*—Charles F. Pigott, Jr.

[57] ABSTRACT

The following specification describes a system for prefabricating a wiring harness by extending the conductors of flat ribbon cable in desired directions to specific or predetermined locations and slitting the insulating lengthwise at those locations to permit selected conductors to project for connection to a contactor terminal.

A projecting conductor is also folded back if it is to be connected to a contact at another location, and to enable the folded back conductor and the other conductors to then extend in a smooth cable, the other conductors are folded at the end of the slit in two reverse legs or three bends corresponding in length to the projection of the connected folded back conductor.

Contacts having insulation piercing shanks of unique design are provided for secure insulation piercing engagement with either folded projecting conductors or terminated conductors.

16 Claims, 7 Drawing Figures

FLAT CABLE WIRING HARNESS AND METHOD OF PRODUCING SAME

BACKGROUND OF THE INVENTION

1. Field of the Invention

This invention relates in general to electrical wiring assemblies and more particularly to a method for prefabricating wiring harnesses together with a more economical wiring harness and an improved contact for establishing a connection to the conductor of a flat ribbon cable.

2. Summary of the Prior Art

In many wiring systems particularly for use in vehicles such as automobiles, it is customary to utilize round hook up wire to extend connections to respective termination points or locations. At each termination point the wire must be stripped to expose the wire, and a contact or terminal crimped onto the exposed wire. If the wire must extend to several locations for multiple connections, splicing may also be required.

In addition, the conductors are generally bundled in a so-called wiring harness or cabling assembly for ease in handling. In order to hold the multiple wires of the harness together, a taping or strapping operation is required, as loose wires can become snarled or damaged, and as a result there are problems in tracing circuits in the event of electrical faults. Due to the requirements for stripping, crimping or other operations, and bundling, the foregoing known wiring harnesses can be relatively expensive, and the connections subject to error.

SUMMARY OF THE INVENTION

The present invention utilizes a flat conductor ribbon cable, together with a unique terminal adapted for insulation piercing the ribbon wire, to provide an economical, prefabricated wiring harness.

The flat conductor ribbon cable comprises a longitudinally extending thin film dielectric matrix having a plurality of longitudinally extending flat conductors or wire strands embedded therein. The wires are thus economically held together and facilely folded to extend in desired directions for enabling the cable to follow a predetermined path. At selected positions in the path, the insulation is slit between conductors to enable the conductors at the end of the slit to be folded back, and thereby provide projecting conductors to which insulation piercing terminals are secured for positioning in conventional connector bodies.

The projecting conductors may either be severed or also be folded back in a double strand if an additional connection is to be made to the projecting conductor at another location. In order to ensure that the cable remains flat, and for minimizing strain thereon, the other conductors, which are folded back at the end of the slit, are provided with a double bend whose length corresponds to the length of the folded back projecting conductor, and all of the conductors then extend in a substantially parallel plane to another location at which connections are to be made.

The terminals for connection to the projecting conductors and insertion in the body of a conductor have a conductor receiving shank portion in which longitudinally spaced insulation piercing tangs or barbs are integrally formed, together with passages and a strain relief boss. Projecting arms on the shank are provided with tangs and passages aligned with shank passages and tangs respectively, and when folded over the projecting conductors, the tangs each penetrate the insulation and enter an aligned passage to establish a secure electrical contact with the conductor. A boss formed on another projecting arm is aligned with a dimple on the shank to capture the insulation therebetween when the other arm is folded over the projecting conductor. The aligned boss and dimple provide strain relief for the projecting conductor.

The arms are folded at positions dependent on whether the connection is established to a single strand projecting conductor or to a double back projecting conductor, and alignment is thereby maintained between the tangs and passages, and between the boss and corresponding dimple.

It is therefore among the objects of the present invention to provide a more economical or improved wiring harness.

It is another object of the present invention to provide an improved method for establishing electrical connections at a plurality of different positions.

It is still another object of the present invention to provide an improved terminal for use in insulation piercing of flat conductor ribbon cable.

Other objects and features of the present invention will become apparent on examination of the following specification and claims, together with the accompanying drawings.

DESCRIPTION OF THE PREFERRED EMBODIMENT

Figures 1, 2, 3:
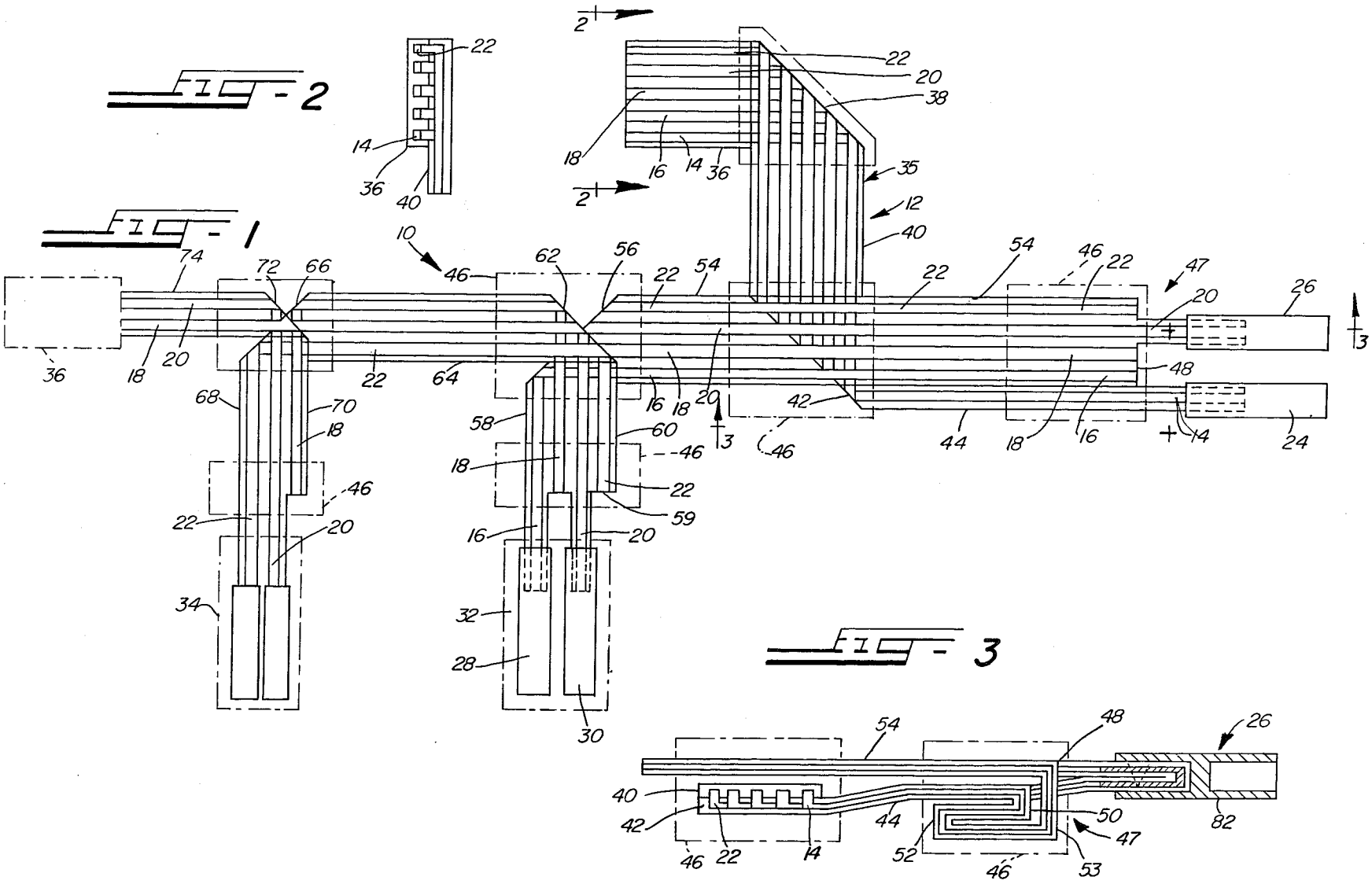
FIG. 1 is a plan view of a wiring harness incorporating the principles of the present invention.
FIG. 2 is a sectional view taken generally along the lines 2—2 in FIG. 1.
FIG. 3 is a sectional view taken generally along the lines 3—3 in FIG. 1.

Referring to FIG. 1, there is shown a flat ribbon cabling harness or cabling assembly 10 incorporating the principles of the present invention. The cabling assembly 10 includes a conventional so-called flat conductor ribbon cable 12 comprising a plurality of flat ribbon like conductors 14, 16, 18, 20 and 22, certain ones of which are connected at predetermined positions to respective contacts such as shown at 24, 26, 28 and 30. The contacts are in turn carried by conventional connectors such as 32 and 34, to enable external connections to be facilely established to or from any one of the conductors 14, 16, 18, 20 and 22.

The cable assembly 10 including the conductors 14–22 are conventionally formed in longitudinally extending side-byside coplanar spaced relationship embedded in a flat plastic or insulating carrier 35. The number of conductors shown is merely exemplary, it being understood that a selected number may be slit from a carrier having a large number of conductors therein. The carrier 35 is preferably transparent and insulates opposite sides and edges of the conductors from each other and from external contact to form a relatively thin sheath for the conductors or wires. The flat conductors have a thickness generally not in excess of 0.015 inch. The total thickness of the cable 12 preferably is not more than about twice the thickness of the individual conductors, and is arranged to provide substantially equal thickness of insulation on each side of the conductors.

The cable 12 is provided with an entry leg 36 in which all of the conductors 14–22 extend from a position (not shown) at which external connections to a common source, for example, are established in a manner that will become clear from the following description. The leg 36 is folded either in a layout fixture or by machine at a selected location to form a 45 degree edge 38 from which the conductors 14–22 extend in a leg 40 perpendicular to leg 36. As seen in FIG. 2, the leg 40 overlaps the leg 36 so as to be located in an adjacent or abutting plane. At a second predetermined position, the leg 40 is folded at a second 45 degree edge 42 for extending conductors 14–22 perpendicular to leg 40 and parallel to leg 36 in a main branch 44. The fold is shown in FIG. 3.

Folds 38 and 42 are merely illustrative, the cable 12 being folded at selected angles and locations to extend the conductors 14–22 in a selected or predetermined pattern. At each location, where a bend is provided, the overlapping cable portions are taped adhesively, bonded or otherwise secured together, as indicated by dashed lines 46, to provide strain relief and hold the desired configuration.

The conductors 14–22 extend in branch 44 to a predetermined termination point or outlet area 47. The insulation or carrier 35 between selected conductors such as 14 and 20 is severed longitudinally from between the adjacent conductors for a selected length at area 47 in an appropriate jig or machine, and a portion of the severed insulation is scrapped or removed if desired. It will be understood, however, that an insulation covering for each conductor is retained.

The insulation between conductors 14 and 20 and the other conductors is severed longitudinally to a predetermined edge 48, and the unsevered portions of branch 44 including conductors 16, 18 and 22 are folded back in a desired direction, in this case parallel to branch 44, along a common fold line or fold edge 48. Conductors 14 and 20 project from fold line 48 for connection to the contacts 24 and 26, respectively, to be assembled in a conventional connector such as 32.

The conductor 14 is severed at its projecting end, as other than at contact 24 no further connection therefor is required. However, conductor 20 is folded back upon itself in a 180° bend from a position coincident with the end of conductor 14. The other three conductors or strands 16, 18 and 22, are folded back upon themselves in a plurality of three reverse bends 50, 52 and 53, as seen in FIG. 3, having a total length equal to the projecting or folded back length of conductor 20, and extending at the end of bend 53 in the direction and coplanar with the folded back portion of conductor 20. The bends 50, 52 and 53, enable conductors 16–22 to smoothly extend in a reduced branch or common cable portion 54 parallel to and overlapping branch 44. The bends 50, 52 and 53, together with branches 44 and 54, are also taped or otherwise secured to each other in the area 46, to form a unitary strain relieved mass.

Branch 54 extends longitudinally for a predetermined distance to another selected location and is then folded at a 45° edge 56 to form a four-conductor arm 58. At any predetermined distance along arm 58 from branch 54, the insulation or carrier 35 of arm 58 is longitudinally slit in a manner similar to that previously described, and alternate conductors 18 and 22 folded back in reverse bends (omitted for the purpose of clarity) similar to bends 50–53, from a selected position or edge 59 at the inner end of the longitudinal slits. The other two conductors or strands 16 and 20 extend from the predetermined position 59, and one conductor 16 is severed at the projecting end. The other projecting conductor 20 is folded back upon itself in a 180° bend, and extends back toward the folded conductors 18 and 22 to rejoin those conductors in an arm 60. The juncture of arms 58 and 60 is thus formed in a manner similar to that explained for branch 54, and the juncture is secured as indicated at 46.

Terminals or contacts 28 and 30 are secured in insulation piercing engagement with the projecting ends of strands 16 and 20, respectively. The contacts 28 and 30 are then assembled in a conventional connector 32. The three conductors 18, 20 and 22, thus extend back in arm 60 overlapping arm 58. Arm 60 is folded along a 45 degree edge 62 to form a new three-conductor branch 64 extending parallel to branch 54 and therefrom to a selected location for folding along edge 66 to form a third arm 68 parallel to arms 58 and 60 and offset therefrom. Two conductors 20 and 22 of the three conductors 18–22 project from the end of arm 68 and are connected to contacts of the connector 34. One of the conductors 20 or 22 is terminated at connector 34, and the other is folded back together with the unconnected conductor 18 in a manner already explained to form a two-conductor arm 70 overlapping arm 68. Arm 70 is folded at an edge 72 to provide a third branch 74 in a manner already explained, and the two conductors of the last branch 74 extend to the contacts of another connector 36 at a selected location.

Thus the cable assembly 10 is prefabricated in a desired geometrical or physical configuration with contacts and connectors at spaced locations, for direct installation in the apparatus in which the external connections are to be established through the connectors, without the need for on site splicing, taping, soldering and/or bundling of the wires.

Figure 4:
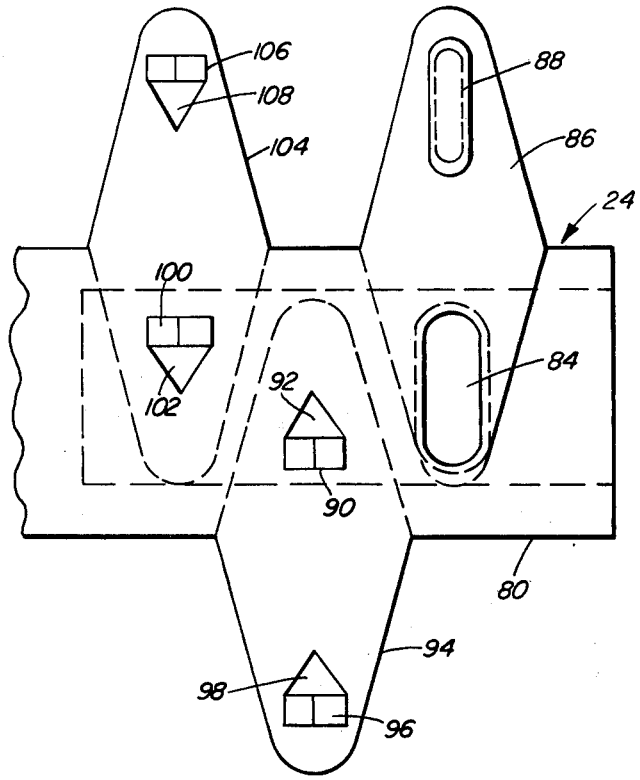
FIG. 4 is a top elevational view of an insulation piercing terminal shank incorporating the principles of the present invention.
Figure 5:
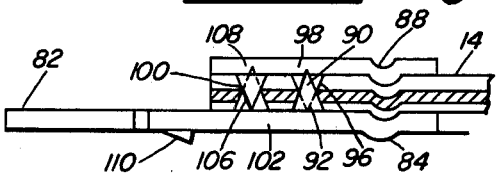
FIG. 5 is a longitudinal sectional view illustrating the terminal shown in FIG. 4 secured to a projecting conductor.

Referring now to FIGS. 4–7, the terminals or contacts 24, 26, 28 and 30 each comprise a generally planar metal shank 80 at one end of a contact portion such as 82 (see FIG. 5) which connects to a mating contact and may be a male or female member or any other type of contact for establishing electrical engagement. The shank 80 receives an insulated strand such as 14–22 at the end opposite contact portion 82, and has a dimple 84 adjacent the conductor receiving end for engaging one side of the conductor insulation. As seen in FIG. 4, an arm 86 extends from one edge of the shank 80 transversely to the longitudinal axis of the shank for folded engagement with the opposite side of the conductor. The projecting arm 86 is provided with a boss 88, with both dimple 84 and mating boss 88 having aligned longitudinal axes transverse to the shank axis, and boss 88 being of slightly smaller dimension than dimple 84. When arm 86 is folded over the conductor, the dimple 84 and boss 88 are brought into registry along their common axis in spaced apart nested registration to deform a portion of the conductor and insulation therebetween and provide strain relief therefor.

Spaced longitudinally along the shank 80 from the dimple 84, and offset from the central axis, is a first tang or barb 90 which is struck from the shank 80 to form a passage 92 extending to the shank axis. A second arm 94 extends transversely from the edge of the shank in a direction opposite arm 86 and parallel thereto. Arm 94 has a second tang or barb 96 formed thereon, together with a passage 98 aligned with tang 90 and passage 92. A third tang 100 and passage 102 are located at a position spaced longitudinally along shank 80 from tang 90, and on the opposite side of the shank axis. A third arm 104 extends from the shank 80 in the same direction as arm 86 and longitudinally spaced therefrom, with arm 104 having a tang 106 and passage 108 in alignment with tang 100 and passage 102.

The projecting end of each of the arms 86, 94 and 104 is formed with an apex to define a generally triangular shape, with the edges of the arms forming an angle of substantially 30 degrees, so that when they are brought into folded engagement with the conductor, each will occupy adjacent longitudinal positions along the shank, as indicated by the dashed lines, to minimize the shank length.

Figure 6:
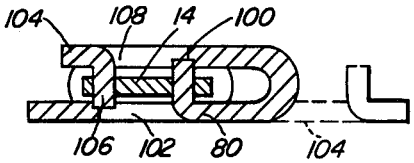
FIG. 6 is a sectional view of the terminal shown in FIG. 4 illustrating the manner in which the terminal is folded for piercing a single projecting conductor.

The arms 86, 94 and 104 are folded in a conventional crimp tool, which may be either machine or manually operated, and when folded about a severed conductor such as 14, only a single conductor thickness extends between the arms and shank. The fold or bend line is therefore offset from the longitudinal margin of the conductor, as indicated in FIG. 6, to bring tangs 90, 96, 100 and 106 into engagement with passages 98, 92, 108 and 102, respectively, while piercing the conductor 14 therebetween so as to establish electrical engagement. The dimple 84 and boss 88 engage the insulation to provide strain relief, and the contact may now be inserted in a conventional connector passage with a retention tine 110 (see FIG. 5) or other expedient providing conventional retention in the connector passage. The contact portion 82 of the contact is provided with any one of a variety of contact configurations, such as a spade contact indicated in FIG. 5, or the receptacle type indicated in FIG. 3. Labels or other indicia are, of course, applied to the connector, if necessary.

Figure 7:
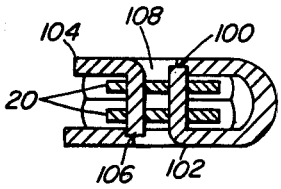
FIG. 7 is a sectional view of the terminal shown in FIG. 4 illustrating the manner in which the terminal pierces the insulation of a folded back projecting conductor.

Referring now to FIG. 7, when the contact 24 is connected to a double strand conductor, such as the projecting end of conductor 20, the bend is formed more closely to the edge of the insulation to accommodate the additional thickness. However, the total length of the folded arms overlapping the conductor is the same as for the single strand, so that the tangs and passageways, together with the dimple 84 and boss 88, are brought into alignment as already described.

In the preferred embodiment illustrated in the drawings and described herein, the flat wiring harness of the present invention is fabricated from multi-conductor cable comprised of a plurality of flat conductors encased within a thin, flat film of dielectric material. The dielectric casing for the conductors is fabricated from two thin, flat sheets of dielectric material which are applied on opposite sides of the plurality of conductors and secured together by adhesive or otherwise sealed at the edges and at locations intermediate the conductors thereby forming a laminated assembly.

It should however be understood that certain modifications of the foregoing preferred embodiment are within the scope of the present invention. For example, some or all of the individual conductors themselves may comprise small diameter round wires rather than flat conductors. In addition, the dielectric casing for the conductors may be extruded, rather than formed from two thin sheets which are laminated together, and where extruded dielectric casing is utilized, the outer shape of the multi-conductor wiring may be other than perfectly flat. For example, in an extrusion operation a rib or projecting portion can readily be formed on the top or bottom of the multi-conductor wiring assembly.

It will thus be understood from the foregoing that the term "flat cable", and terms of like import as used herein and in the appended claims, means a multi-conductor cable having several flat or round conductors encased in a dielectric which is extremely thin and quite wide, so as to provide a substantially flat shape. It should however be understood that the insulation displacement terminal, as shown in FIGS. 4–7, is intended to be used only with flat cable of a type where the conductor wires are themselves flat conductors, as shown for example in FIGS. 1–3.

What is claimed is:

1. A cable harness assembly comprising:

a flat ribbon cable having a plurality of longitudinally extending conductors encapsulated in a longitudinally extending insulator for insulating said conductors from each other and from external engagement, said cable folded at respective positions for extending said conductors in a selected direction to a first termination position at which said insulator is longitudinally slit to form a first projecting conductor extending from a fold edge of said cable, a folded end on said projecting conductor for extending said conductor in the direction of said cable fold edge, means establishing an electrical connection to the projecting conductor, and a plurality of reverse bends in another conductor of said cable extending from said fold edge at the end of said slit and having a length substantially equal to the folded projecting portion of said projecting conductor for extending said one and other conductor in a common cable portion to another position.

2. The harness assembly claimed in claim 1 in which said cable is longitudinally slit to provide another projecting conductor severed at a projecting end coincident with the folded end of said folded projecting conductor.

3. The harness assembly claimed in claim 2 in which said severed projecting conductor is located adjacent an edge of said insulator.

4. The harness assembly claimed in claim 3 in which said means for establishing an electrical connection comprises a contact having insulation piercing means for piercing a selected one of said projecting conductors.

5. The harness assembly claimed in claim 4 in which said insulation piercing means comprises a pair of tangs each aligned with a respective passage, and a first arm having one of said tangs and one of said passages and folded at one position into overlapping engagement with said folded projecting conductor to pierce said folded conductor in opposite directions for engaging each of said tangs in a respective passage.

6. The harness assembly claimed in claim 5 including a second pair of tangs each aligned with a respective passage, and a second arm having one of said tangs and one of said passages folded into overlapping engagement with said folded projecting conductor at a location longitudinally spaced from said first arm to pierce said folded conductor in opposite directions and for engaging each of said tangs in a respective passage.

7. In a harness assembly as claimed in claim 6, matching boss and dimple members which cooperate to grip said conductor therebetween, one of said boss and dimple members being formed on a third arm longitudinally spaced from said first and second arms and folded into overlapping relation with said conductor with said boss and dimple members in registry.

8. The harness assembly claimed in claim 7 in which said contact is adapted to be received and retained in the passage of a connector body.

9. A method for prefabricating a cable harness assembly comprising the steps of;

providing a flat ribbon cable having a plurality of longitudinally extending conductors encapsulated in a longitudinally extending insulator for insulating said conductors from each other and from external engagement, folding said cable at respective positions for extending said conductors in a selected direction to a first termination position, slitting said insulator longitudinally between a pair of conductors to project one conductor from a fold edge of said cable, folding said one conductor at an end spaced from said fold edge to extend said conductor in the direction of said fold edge from said folded end, and providing a plurality of reverse bends in said other conductor of said pair extending from said fold edge and having a length substantially equal to the length of said folded conductor projecting from said fold edge for extending said pair of conductors in coplanar relationship in a common cable portion.

10. In the method claimed in claim 9 the step of extending said folded conductor in said common cable portion to a second termination position, and the step of slitting said cable between said pair of conductors at said second position to enable said one conductor to project separately from a second fold edge of said cable at said other position.

11. In the method claimed in claim 9, the step of providing a third longitudinally extending conductor in said cable, slitting said cable longitudinally adjacent said third conductor to enable said third conductor to project from said cable, and severing said third conductor at a position coincident with the folded end of said one conductor.

12. In the method claimed in claim 11 the step of selecting the third conductor adjacent an edge of said cable.

13. In the method in claim 12 the step of providing an insulation piercing terminal for each projecting conductor to establish electrical engagement with the respective conductor.

14. In the method claimed in claim 13 the step of providing a connector body for receiving each insulation piercing terminal.

15. An insulation piercing terminal for establishing electrical engagement with either one strand or a plurality of strands of a flat ribbon conductor embedded in the insulating material of a flat ribbon cable, the improvement comprising;

an elongate shank portion on said terminal having a plurality of spaced tangs offset in opposite directions from the longitudinal axis of said shank portion with a passage adjacent each tang extending toward said axis, an arm extending transversely to said axis from an edge of said shank portion for each tang and passage with each arm having a tang and passage aligned with a respective one of said spaced tangs and passages, and means for enabling each arm to be folded for overlapping a conductor of said cable and for passing each tang through said conductor and engaging the tang of each arm in a respective one of said spaced passages and the spaced tangs in a respective arm passage in response to either one strand or a plurality of strands of said conductor being located between said shank portion and said arms.

16. In the terminal claimed in claim 15, a dimple on said shank portion having an elongate axis transverse to said shank axis, a further arm extending transversely to said shank axis and having a boss thereon aligned with said dimple and adapted to register with said dimple in response to the folding of said further arm over a conductor having either one strand or a plurality of strands between said further arm and said shank portion.

* * * * *